US006773768B2

(12) United States Patent
Weiser

(10) Patent No.: US 6,773,768 B2
(45) Date of Patent: Aug. 10, 2004

(54) NOVELTY WITH SPRING ATTACHED APPENDAGES

(75) Inventor: Margaret Weiser, Tarzana, CA (US)

(73) Assignee: Exhart Environmental Systems, Inc., Chatsworth, CA (US)

( * ) Notice: Subject to any disclaimer, the term of this patent is extended or adjusted under 35 U.S.C. 154(b) by 146 days.

(21) Appl. No.: 10/335,640

(22) Filed: Dec. 30, 2002

(65) Prior Publication Data

US 2004/0126506 A1 Jul. 1, 2004

(51) Int. Cl.[7] ..... A01N 1/00; G09F 19/08; A63H 3/36; F16M 13/00; A01M 31/06

(52) U.S. Cl. ..... 428/16; 40/415; 40/417; 40/418; 446/97; 446/320; 446/384; 248/160; 248/623; D22/125; 43/2; 43/3; D21/576; D21/585; D21/606

(58) Field of Search ..... 428/6, 16; 40/415, 40/417, 418; 446/97, 320, 381, 92, 121, 309, 317; 248/160, 623; D22/125; D6/315; D11/158, 162; 211/3, 30, 33; 206/8, 9; 43/2, 3; D21/398, 576, 585, 594, 596, 606; 190/136

(56) References Cited

U.S. PATENT DOCUMENTS

| | | | | |
|---|---|---|---|---|
| D35,246 S | | 10/1901 | Stowell | |
| 814,313 A | | 3/1906 | Norton | |
| 1,224,044 A | | 4/1917 | Thurman | |
| 1,652,775 A | | 12/1927 | Funk, et al. | |
| 1,710,478 A | | 4/1929 | Hoppin | |
| 1,837,662 A | | 12/1931 | Jacobs | |
| D138,777 S | | 9/1944 | Lewis | |
| D147,378 S | | 8/1947 | Rouse | |
| D161,962 S | | 2/1951 | Plante | |
| 2,663,970 A | * | 12/1953 | Brodrib | 446/317 |
| 2,729,022 A | | 1/1956 | Polk | |
| 2,760,303 A | | 8/1956 | Del Mas | |
| D181,009 S | | 9/1957 | Lakin | D34/15 |
| 2,816,384 A | | 12/1957 | Rexius | |
| D192,254 S | | 2/1962 | Hanson | D34/15 |
| 3,435,550 A | | 4/1969 | Carlson | |
| D294,843 S | | 3/1988 | Lund | D21/204 |
| D301,992 S | | 7/1989 | Zumwalt | D11/158 |
| D324,353 S | | 3/1992 | Urso | D11/162 |
| D337,358 S | | 7/1993 | Orak | D21/160 |
| D382,029 S | | 8/1997 | Hong Cheng | D21/161 |

* cited by examiner

*Primary Examiner*—Deborah Jones
*Assistant Examiner*—G. A. Blackwell-Rudasill
(74) *Attorney, Agent, or Firm*—Cislo & Thomas LLP

(57) ABSTRACT

A spring novelty item which has a head and appendages attached to a body by means of a spring connecting means so as to add dynamic and aesthetic beauty to any garden, kitchen or other setting.

11 Claims, 4 Drawing Sheets

NOVELTY WITH SPRING ATTACHED APPENDAGES

BACKGROUND OF THE INVENTION

1. Field of the Invention

This invention relates to spring novelty items of the type that may be placed or staked into a lawn or garden or used in a kitchen or other room in order to add aesthetic value thereto.

2. Description of the Related Art

Various novelty items are known wherein the novelty items represent various doll-like or whimsical figures wherein the appendages may have spring connections to the body. See, for example, U.S. Pat. No. 2,760,303 which is directed to ARTICULATED FIGURE TOY. In other instances a bird or the like having a body wherein the head is connected by a coil spring is shown in U.S. Design Pat. No. 337,358 entitled LINKING BIRD.

While the various novelty items that have been disclosed in the prior art utilize in some instances spring attachments for appendages none of which Applicant is aware shows a wholly fanciful figure as, for example, a person, an animal, a bird or the like wherein each of the head and other appendages are connected to the body by reason of spring connectors having a K-factor that allow for easy movement of the attached components to the body. In the case of a garden stake article none is known wherein at least one of the legs of the animal, bird or the like comprises a spring connector which terminates in a stake having a double forked end or a single forked end for easy staking in the garden and wherein the novelty item is finished with an enamel of brightly colored paint to thereby simulate a whimsical caricature of an animal or the like. Additionally, the stake aspect may be terminated in a stand which supports the novelty.

With the hereindisclosed invention a whimsical, aesthetically pleasing novelty item is disclosed which adds visual beauty to any setting. Additionally, the novelty items of the invention utilize components which are attached to a body simulating a vertebrate, animal, bird or the like wherein the attachment means in a specific embodiment is a coiled spring having a K-factor such that passage of wind or vibrations or the like will make for dynamic movement of the novelty item in any setting whether it be garden or kitchen thereby adding to enjoyment to the observer thereof.

SUMMARY OF THE INVENTION

The present invention is directed to a whimsical caricature wherein a body has associated therewith either wings, arms, head and legs each of which are connected by means of a spring means or coil spring having a K-factor that is relatively and selectively chosen such that, depending upon the weight of the appendage being supported, the same may be easily moved through vibrational or other forces impacted thereon relative to the body with which it is associated.

While the invention may be described in specific detail with regard to a bird and cartoon-like article, it is not to be so narrowly construed inasmuch as the same inventive concept may be applied to humans, vertebrates, animals, insects, fish or the like, it only being important that the appendages of the simulated article be connected to a body by means of a spring connecting means which ideally, and in the preferred embodiment, takes the configuration of a coil spring. However, other spring configurations may be utilized just so long as the attributes of the disclosed invention are obtained.

With the herein disclosed invention a garden novelty item is obtained which the prior art does not teach, suggest or disclose and which provides for obtaining a whimsical, cartoon-like characterization or caricature of a vertebrate, animal or a bird, fish or the like.

OBJECTS OF THE INVENTION

It is an object of the present invention to provide a novelty item which is whimsical in nature and aesthetically pleasing to view.

It is another object of the invention to provide a novelty item which has movable elements for enhancing visual enjoyment of a varied setting.

It is still another important object of the invention to provide a whimsical caricature of a vertebrate, animal, bird or the like wherein the appendages and head of the vertebrate, animal, bird or the like are connected to the body thereof through a connecting means which provides for movement of the connected members relative to the body.

It is still another important and specific object of the invention to provide a ornamental novelty taking the form of a bird caricature wherein the head, wings and legs of the bird are attached through spring connecting means which provide for easy movement of the connected elements relative to the body and wherein at least one of the legs of the bird is configured so as to be able to stake the same into a garden setting or be received into a suitable stand.

These and other objects and advantages of the present invention will be apparent from a review of the following specification and accompanying drawings.

BRIEF DESCRIPTION OF THE DRAWINGS

FIG. 5 is a schematic representation showing alternative form of stake for staking the novelty item in FIG. 1 in a garden or the like;

DESCRIPTION OF THE PREFERRED EMBODIMENT(S)

Figure 1:
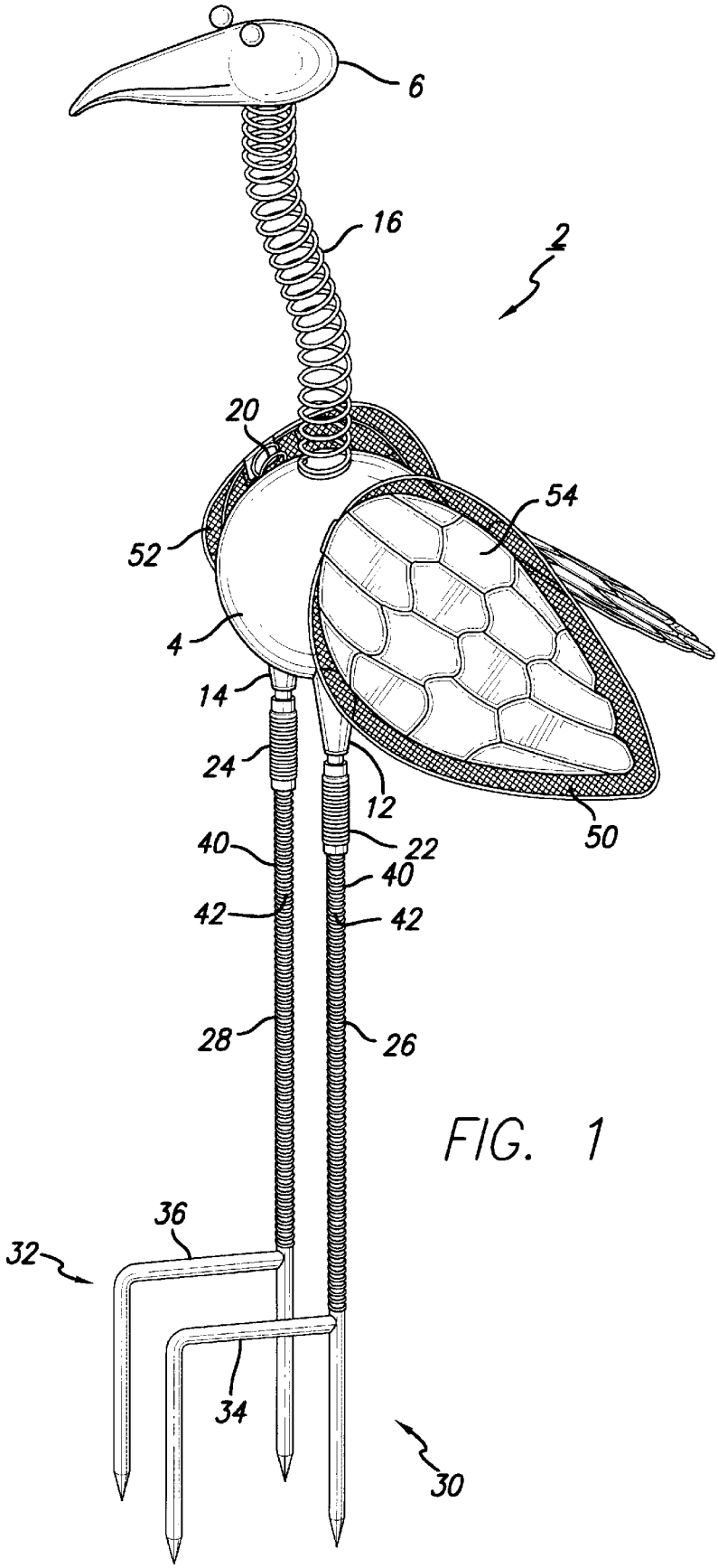
FIG. 1 is a perspective view of the inventive, decorative novelty item of the invention as embodied in a whimsical bird.

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Basically, the invention is directed to a novelty item comprising the combination of a simulated vertebrate, animal, bird or the like having a head, a body and appendages, each of said head and appendages being operatively connected to the body through a spring connecting means wherein the K-factor of the spring connecting means is such as to allow each of the head and appendages to be easily movable through spring action relative to the body and to be freely and easily movable thereto. In the case of the embodiment of the invention being directed to a garden item, at least one stake means extends from the body and wherein the stake means simulates a leg of the simulated vertebrate, animal, bird or the like which additionally may be received into a stand where staking is not desired.

Referring to FIGS. 1–6 of the drawing wherein like members of reference designate like elements throughout it will be seen that the novelty item in this particular instance takes the form of an avian caricature and it will be seen that the garden novelty 2 as indicated takes the form of a bird having a body 4, a head 6 and wings 8 and 10 as well as leg extensions 12 and 14 and wherein it will be noted that each of the head, wings and appendages are associated with the body 4 by means of a spring connecting means 16, 18, 20, 22 and 24 respectively.

With respect to the spring connecting means 16 it will be seen that the same takes the form, in one embodiment, of a coil spring somewhat extensive in length and having a K-factor such that when the garden novelty 2 is staked or placed on its stand in the garden or the like that vibrational movement of the ground or movement caused by the wind will impart dynamic action and movement of the head 6 relative to the body 4.

Likewise the wings 8 and 10 being associated with the body 4 through spring connectors 18 and 20 here again taking the form of coil springs but being substantially shorter in length but again having a K-factor that depending upon the weight of the wings 8 and 10 is such that vibrational movement either imparted through the novelty item 2 from the ground or by means of a wind in the ambient atmosphere in which the ornamental novelty 2 is placed, will cause the wings to have some dynamic action or simulated flapping thereof.

Connected to the legs 12 and 14 are spring connectors 22 and 24 in this particular instance taking the form of a coil spring of diameter larger than the depending leg extensions 26 and 28 terminating in stake portions 30, and 32 in this particular instance taking the form of a double fork rods 34 and 36 having pointed termini for ease of implantation into soil or the like.

The leg extensions 26 and 28 which are welded, soldered or otherwise connected to legs 12 and 14 are composed of rods 40 about which a coil spring 42 is wrapped thereabout and the only movement that is obtained to the garden novelty item 2 through the leg portions 26 and 28 is obtained through the intermediate spring connecting means 22 and 24 respectively, which hereagain are configured in the form of coil springs again having a K-factor depending upon the weight being supported thereby being selected such that the dynamic movement of the novelty item 2 is obtained. Operable connections, as those of ordinary skill in the art will recognize may take the form of mechanical connections or weld and/or solder joining.

In the embodiment depicted the ornamental novelty 2 and more specifically the wings 8 and 10 are fabricated of a wire mesh 50 and 52 respectively and has overlaid thereon a thin, metal enameled representation of feathers plates 54 and 56 respectively. These metal plates 54 and 56 are as indicated configured and as shown as to simulate feathers and may be of various colors and may be chosen to be whimsical in nature and preferably are of a high lacquer finish so that the same will withstand the ambient elements as well as be reflective and pleasing to look at. The same may be said for the exterior finish of the remainder of the novelty item 2 with the colors for the head and legs, etc. being selected as a matter of choice, the same being chosen so as to make the ornamental novelty 2 as attractive to the eye as possible depending upon the end result to be obtained.

Figure 5:
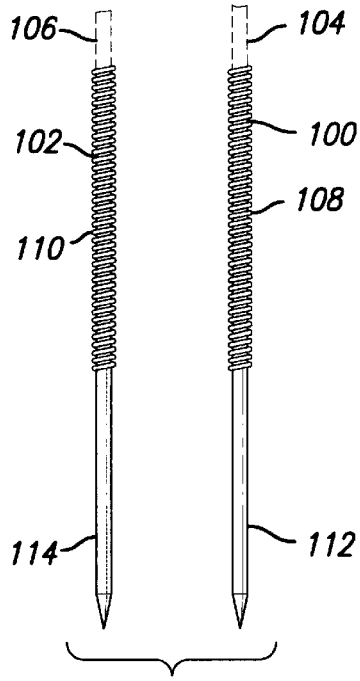
Figure 2:
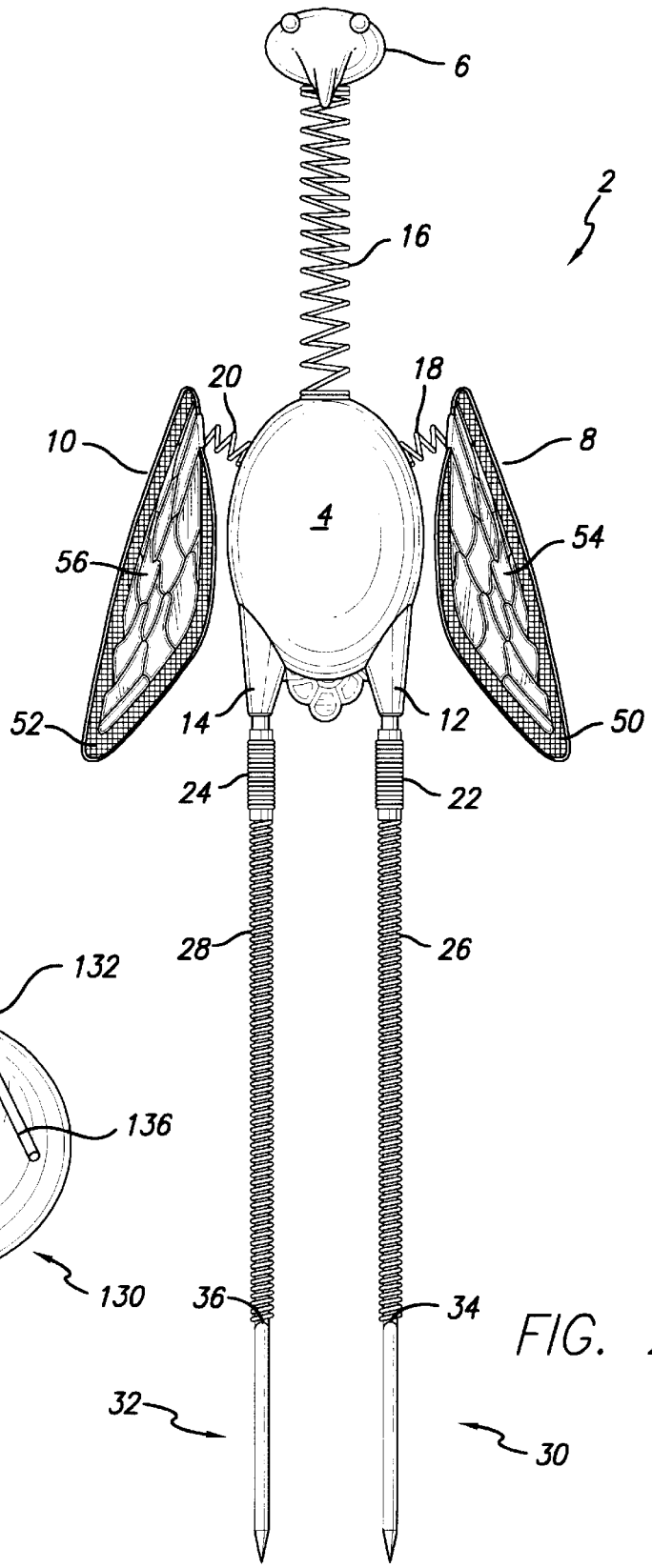
FIG. 2 is a front view of the novelty item shown in FIG. 1 illustrating additional detail thereof.
Figure 6:
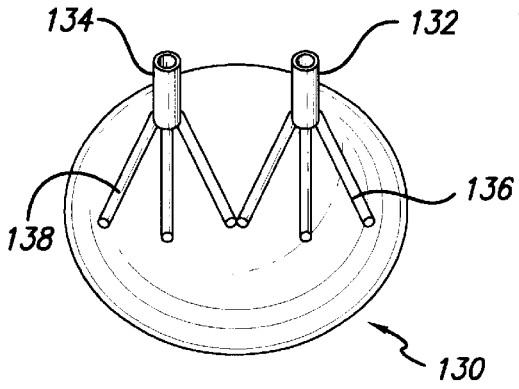
FIG. 6 depicts a suitable stand for the novelty item depicted in FIG. 1 wherein staking is not desired.
Figure 3:
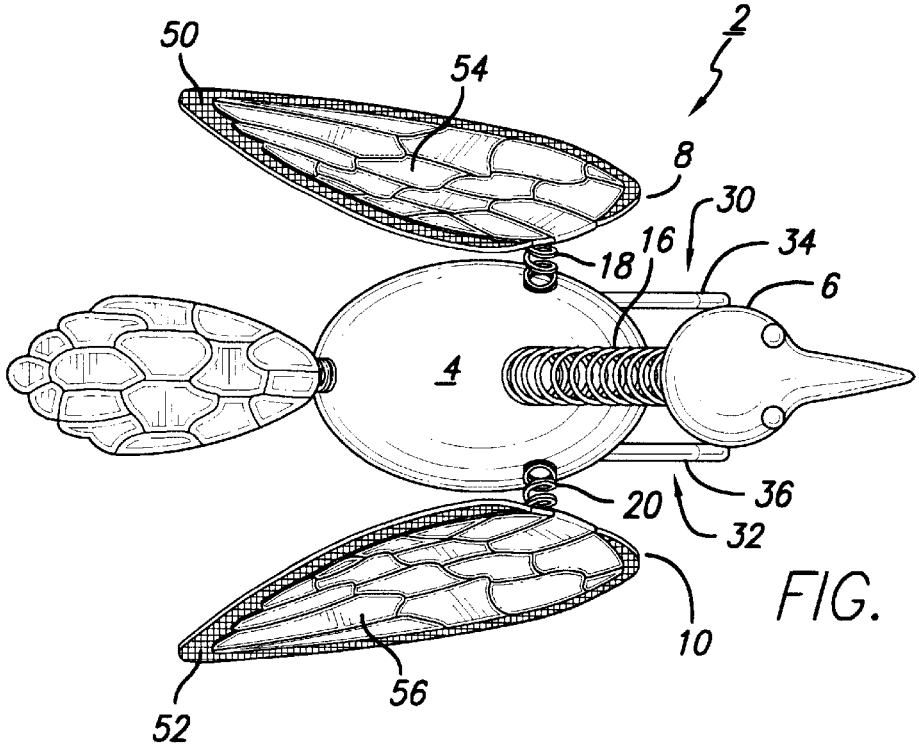
FIG. 3 is top view of the novelty item depicted in FIG. 1.
Figure 4:
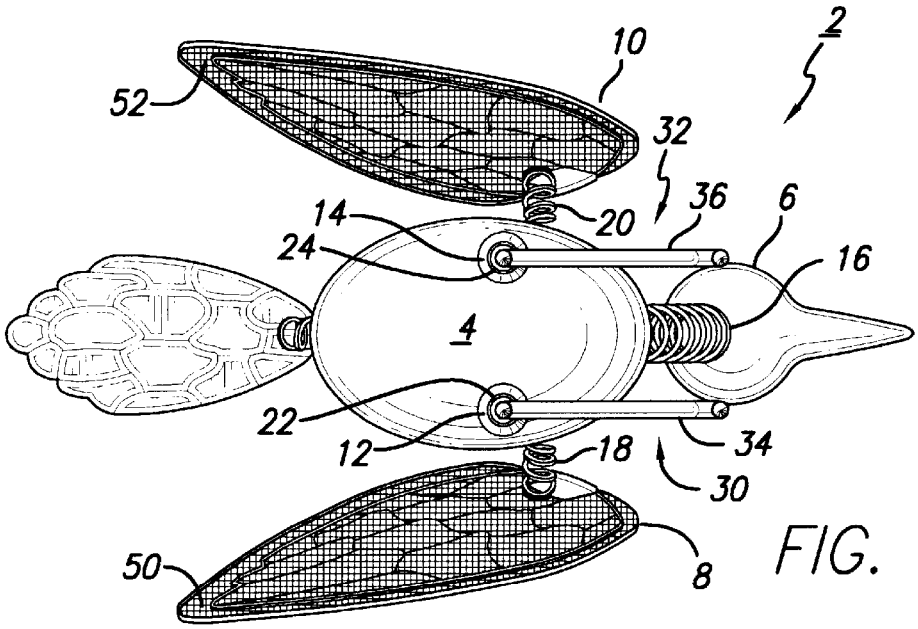
FIG. 4 is a bottom view of the novelty item depicted in FIG. 1.

While the embodiment shown in FIGS. 1–4 inclusive show the double stake support, there is shown in FIG. 5 a representation in schematic fashion of legs, for example, 100 and 102 hereagain comprised of the rods 104 and 106 about which is wrapped the coil spring 108 and 110 respectively but here terminating in a single, pointed termini 112 and 114 respectively. For this embodiment of the invention, where staking is not desired, and referring to FIG. 6, a stand 130 of cast metal or the like has spaced upstanding tubular holders 132 and 134 terminating in simulated feet 136 and 138. The tubular holders 132 and 134 are adapted to receive the termini 112 and 114 respectively. The stand 130 is of sufficient size and weight to be able to support the novelty 2 with which it is associated.

Figure 7:
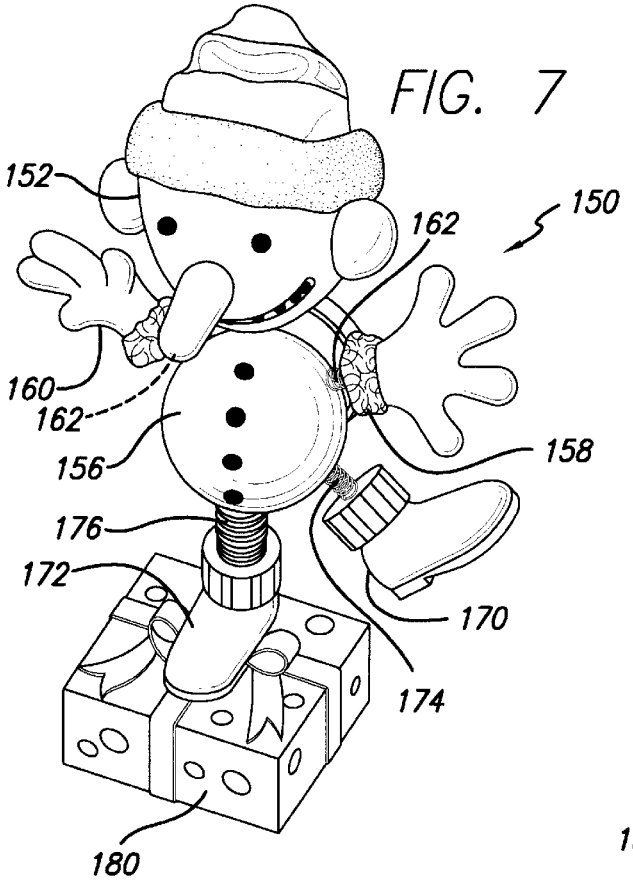
FIG. 7 depicts a novelty item taking the form of a whimsical vertebrate employing a stand.
Figure 8:
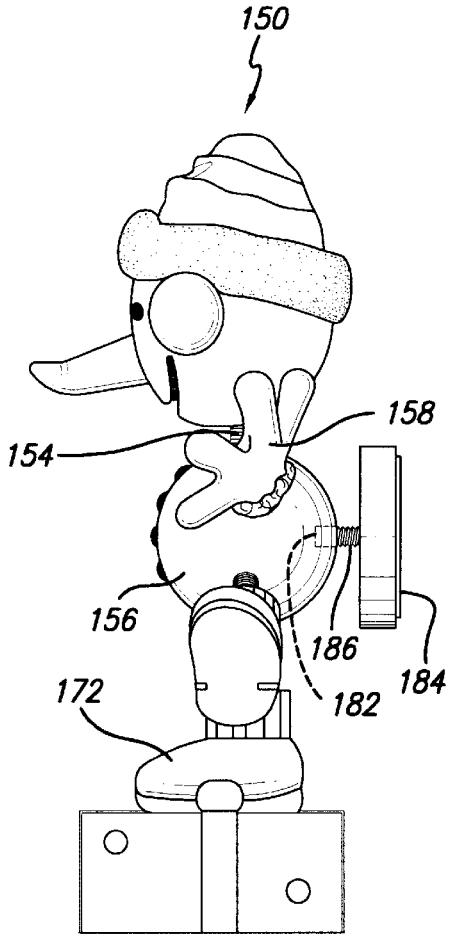
FIG. 8 is a side view of a novelty item illustrating another form of securement.
Figure 9:
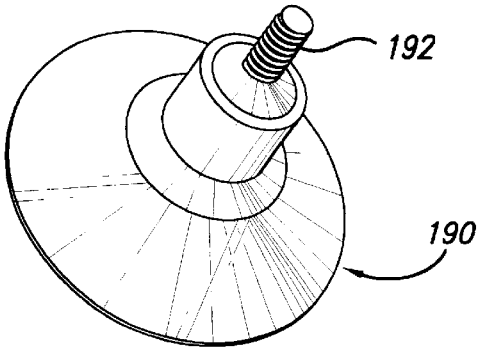
FIG. 9 is a perspective view of yet another form of securement for the novelty item depicted in FIGS. 7 and 8.

Referring to FIGS. 7, 8 and 9 there is shown application of the inventive concepts to a vertebrate or whimsical simulated human 150 which as can be seen has a head 152 supported through coil spring 154 to the body 156 to which is also attached arms 158 and 160 hereagain through coil springs 162.

It will be noted that in addition to the appendages already described that the novelty item 150 has leg or foot members 170 and 172 again connected to the body 156 through coil spring 174 and 176 respectively.

In this particular instance, rather than having a stake or other stand, the stand 180 is rectangularly shaped and of cast metal or other materials of sufficient weight in order to support the novelty item 150. Where it is desired to have the novelty item 150 supported, for example, from a refrigerator, the body 156 is provided with a threaded aperture 182 which receives magnet member 184 by means of threaded bolt 186 (FIG. 8). In like fashion where it is desired to have a support other than magnet 184 a suction cup 190 as seen in FIG. 9 may be substituted for the magnet in which event the suction cup 190 is threaded into the threaded aperture 182 by means of threaded bolt 192 for attachment to a surface as those of ordinary skill in the art will once recognize.

While the invention has been described with respect to a simulated vertebrate and bird, those of ordinary skill in the art will of course recognize that the same principles may be applied to other animals, fish, insects and the like wherein it is desired to have a whimsical, dynamically active novelty item for garden, kitchen or the like it only being important that the head and appendages, whether they be arms, wings or legs or the like, be connected to a body through a spring connecting means which allows for easy movement of the spring supported members or appendages.

Additionally, with respect to the embodiments of FIGS. 1–6, while a dual support means has been shown it is of course within the comprehension of the invention that a singular stake be used which would take the place of either one of the extending stake legs 26 or 28 such that but a single rod can be used to support the animal, bird or the like. Also, while the invention has been described with respect to a specific construction of elements and finishes those of ordinary skill the art will of course recognize that these are mere matter of choice selections and that other finishes, etc. may be utilized.

Further, those of ordinary skill in the art will recognize that the spring connectors, their K-factors, weight and size will be dictated by the appendage or body it is intended to support and still achieve the movement of the novelty desired.

Thus there has been disclosed a whimsical novelty article taking the form of a whimsical vertebrate, bird, animal or the like that will add dynamic pleasure to any setting whether it be garden, kitchen or other setting.

What is claimed is:

1. A novelty comprising the combination of:

a simulation of a vertebrate, animal, bird or the like having a head, body and appendages, each of said head and appendages being operatively connected to said body through an individual spring connector means wherein the K-factor of each of the individual spring connector means is such as to allow each of said head and appendages to be movable through spring action relative to said body and at least one support extending from said body for securement of said novelty and simulating a leg of said vertebrate, animal, bird or the like.

2. A novelty comprising the combination of:

a simulation of a vertebrate, animal, bird or the like having a head, body and appendages, each of said head and appendages being operatively connected to said body through spring connector means wherein the K-factor of the spring connector means is such as to allow each of said head and appendages to be movable through spring action relative to said body and at least one support extending from said body for securement of said novelty and simulating a leg of said vertebrate, animal, bird or the like wherein said novelty has an extending simulated leg which acts as a garden stake and wherein the stake is double pronged for insertion into the ground or stand.

3. The novelty in accordance with claim 1 wherein said novelty takes the configuration of a bird.

4. The novelty in accordance with claim 3 wherein the body of said bird is finished in an enamel finish.

5. The novelty in accordance with claim 1 wherein said stake means is single pronged for insertion into the ground or support.

6. The novelty in accordance with claim 4 wherein the spring connector comprises coil springs.

7. The novelty in accordance with claim 6 wherein said wings are fabricated of wire mesh.

8. The novelty in accordance with claim 7 wherein said wire mesh wings have an overlaid metal plate configured to represent feathers and is multi-colored.

9. The novelty in accordance with claim 8 wherein said bird is a fanciful caricature.

10. The novelty in accordance with claim 1 wherein the extending leg comprises a rod element having a coil wire thereabout.

11. A garden stake novelty comprising the combination of:

a simulation of a bird having a head and wings wherein each of said head and wings are operatively connected to the body through a coil spring wherein the K-factor of the spring is such as to allow easy movement of the head and wings and wherein said body has two extending leg portions, each of which are connected to extending rods for insertion into the ground and the connecting means between the leg portions and the connecting rod portions being intermediate coiled spring members which allows for movement of said body relative to said extending leg members and wherein said extending leg members comprise rods about which a coil spring is wrapped with the termini of said rods configured in a double forked configuration.

* * * * *

UNITED STATES PATENT AND TRADEMARK OFFICE

CERTIFICATE OF CORRECTION

PATENT NO. : 6,773,768 B2
DATED : August 10, 2004
INVENTOR(S) : Weiser, Margaret It is certified that error appears in the above-identified patent and that said Letters Patent is hereby corrected as shown below:

Column 5,
Line 28, after "support" insert -- comprising a stake means --.

Signed and Sealed this

Seventh Day of June, 2005

JON W. DUDAS
*Director of the United States Patent and Trademark Office*